United States Patent [19]

Pool

[11] Patent Number: 4,538,035

[45] Date of Patent: Aug. 27, 1985

[54] JOYSTICK OCCLUSION GATE CONTROL FOR VIDEO GAMES

[76] Inventor: Danny J. Pool, 2942 Indian Creek, Bishop, Calif. 93541

[21] Appl. No.: 541,687

[22] Filed: Oct. 13, 1983

Related U.S. Application Data

[63] Continuation-in-part of Ser. No. 446,508, Feb. 11, 1983, Pat. No. 4,479,083.

[51] Int. Cl.[3] ..... H01H 25/04

[52] U.S. Cl. ..... 200/6 A; 200/153 K

[58] Field of Search ..... 200/6 A, 153 K; 74/471 XY

[56] References Cited

U.S. PATENT DOCUMENTS 2,507,016 5/1950 Hesh ..... 200/6 A 4,470,320 9/1984 Kim ..... 200/6 A X

*Primary Examiner*—A. D. Pellinen

*Assistant Examiner*—Morris Ginsburg

*Attorney, Agent, or Firm*—William H. Maxwell

[57] ABSTRACT

A selectively positionable secondary gate controlling the mode of operation of a joystick for restricted movement about X and Y axes to actuate opposed switches disposed in pairs on the X and Y axes and operable in an eight-way mode to actuate adjacent corner switches as well as single axially aligned switches, and operable in a four-way mode to alternately actuate only axially aligned switches, and all of which is embodied in a spring biased assembly characterized by a primary gate permitting normal operation and said positionable secondary gate restricting operation.

34 Claims, 19 Drawing Figures

(Eight-Way Mode)

(Four-Way Mode)

(Eight-Way Mode)

(Four-Way Mode)

(Eight-Way Mode)

(Four-Way Mode)

JOYSTICK OCCLUSION GATE CONTROL FOR VIDEO GAMES

This is a continuation-in-part of co-pending application Ser. No. 446,508 filed Feb. 11, 1983 and issued Oct. 23,1984 as U.S. Pat. No. 4,479,083, entitled MODE CONDTIONED JOYSTICK CONTROL FOR VIDEO GAMES.

BACKGROUND

This invention has to do with video games and the like where control of a cathode-ray tube display is by means of a "joystick". Generally, joysticks of the type under consideration move about X-Y axes to govern complementary display coordinates on a display screen. Control is by electrical contacts opened or closed by movement of the joystick about said X-Y axes to operate any one of four pairs of switch contacts, or simply to operate any one of four separate switches. A four-way switching arrangement in which there are four distinct switching conditions is one in which only one of four switches is operable at a time. However, there are situations in addition to the foregoing four switching conditions where adjacent switches on axes X and Y are simultaneously operable, in which case there are eight distinct switching conditions, and this being an eight-way switching arrangement. It is a general object of this invention to provide for mode changes in a video game joystick, by the use of a selectively positioned gate that restricts movement of the joystick and switch operation according to the mode desired, for example the aforesaid fore-way or eight-way switching modes as circumstances require.

The restrictive movement of the joystick is also controlled by the present invention to operate in either of the aforementioned four-way and eight-way modes of operation. To this end it is an object of this invention to provide selective gating by which the desired mode can be established. In practice, there is an eight-way mode determined by a first normal position of a control gate, and there is a four-way mode determined by a second alternate position of the control gate. The joystick unit with the gate as it is disclosed herein can be selectively conditioned into the desired mode of operation as circumstances require.

Typical joysticks of the type referred to above are gimbaled in right angularly related yokes supported upon axis pins, one yoke within the other, and with stops for limited movement applied in a surrounding cage. In accordance with the invention disclosed in the above referenced patent, there is the elimination of angular yokes, supporting gimbal pins, cages and the like, and with reliance entirely upon the joystick and support plate configurations having inherent movement limits for normal operation. The joystick is a straight member that can freely rotate, and that operates the switch contacts through a concentric cam which serves as a spring set held in place by a single snap ring or clip. A selectively positionable gate surrounds the joystick and controls its mode of operation from a normal eight-way mode to a four-way mode as circumstances require.

SUMMARY OF THE INVENTION

This invention relates to video game joysticks that actuate switches disposed oppositely on X and Y axes, for example fore-and-aft, and side-to-side or transverse axes. In practice, there is a normally centered switching cam adapted to be displaced by manipulation of the joystick to engage the switches, the switches being disposed diametrically opposite and normally spaced from the periphery of the cam along respective axes. Accordingly, there are four switches spaced 90° apart and with the contact elements thereof spaced from the periphery of the cam when it is centered, the cam being laterally displaceable to engage any one or two adjacent contact elements. In practice, leaf switches are most often employed with right angularly related contact elements as shown, so that cam displacement along either axis X or Y engages a single contact element, and so that diagonal cam displacement engages two adjacent right angularly related contact elements. The joystick is yieldingly biased into a centered and erect position by a compression spring seated in the cam, and it projects through a normally restrictive opening in a mounting plate. A feature of this invention is mode control by means of a selectively positionable gate for operation as a four-way as distinguished from an eight-way joystick unit.

The foregoing and other various objects and features of this invention will be apparent and fully understood from the following detailed description of the typical preferred forms and applications thereof, throughout which description reference is made to the accompanying drawings.

DESCRIPTION OF THE DRAWINGS

FIG. 1 being a perspective view of a joystick control embodying the features of the present invention.

FIG. 2 is a bottom view taken as indicated by line 2—2 on FIG. 1.

FIG. 3 is an enlarged fragmentary sectional view as indicated by line 3—3 on FIG. 1, and FIG. 4 is a view similar to FIG. 3 showing a displaced position of the joystick.

FIG. 5 is an exploded perspective view showing the gate elements positioned to establish an eight-way mode of operation, and FIG. 6 is a plan view thereof.

FIG. 7 is an exploded perspective similar to FIG. 5 showing a displaced position of the gate elements to establish a four-way mode of operation, and FIG. 8 is a plan view thereof.

FIGS. 9 and 10 are bottom views similar to FIG. 2 showing the eight-way and four-way modes of operation respectively, FIG. 9 showing diagonal shifting of the cam into one of the four corners so as to actuate adjacent switches, and FIG. 10 showing diagonal shifting of the cam restricted from corner actuation of either of said adjacent switches.

FIG. 11 being a plan section showing the eight-way mode of switching, by means of retracted abuttment pins.

FIG. 12 is a sectional view taken as indicated by line 12—12 on FIG. 11.

FIG. 13 is a view similar to FIG. 11 and shows the occluding position of the gate which provides four-way operation, and FIG. 14 is a sectional view taken as indicated by line 14—14 on FIG. 13.

FIG. 15 being a plan section showing the eight-way mode of switching, by means of separated abuttments.

FIG. 16 is a sectional view taken as indicated by line 16—16 on FIG. 15.

FIG. 17 is a view similar to FIG. 15 and shows the occluding position of the gate which provides four-way operation.

FIG. 18 is a sectional view taken as indicated by line 18—18 on FIG. 17, and FIG. 19 is a sectional view taken substantially as indicated by line 19—19 on FIG. 18.

PREFERRED EMBODIMENTS

Figure 1:
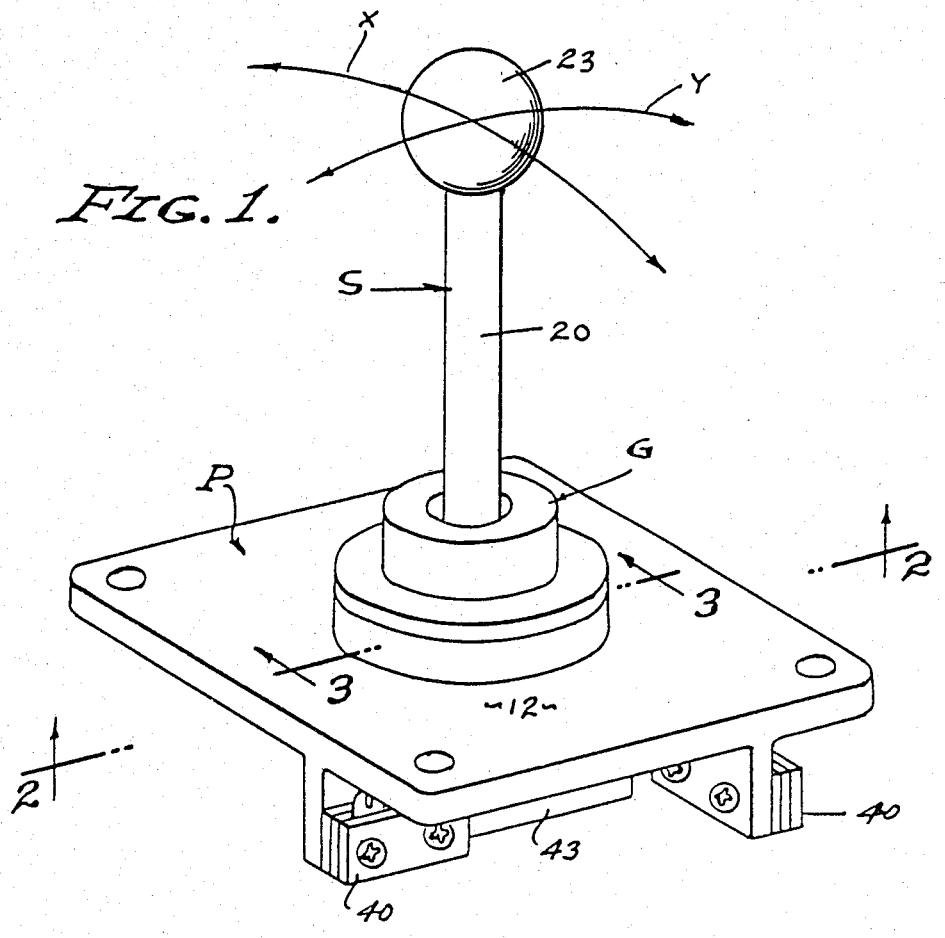
FIGS. 1 through 10 show a first embodiment.
Figure 2:
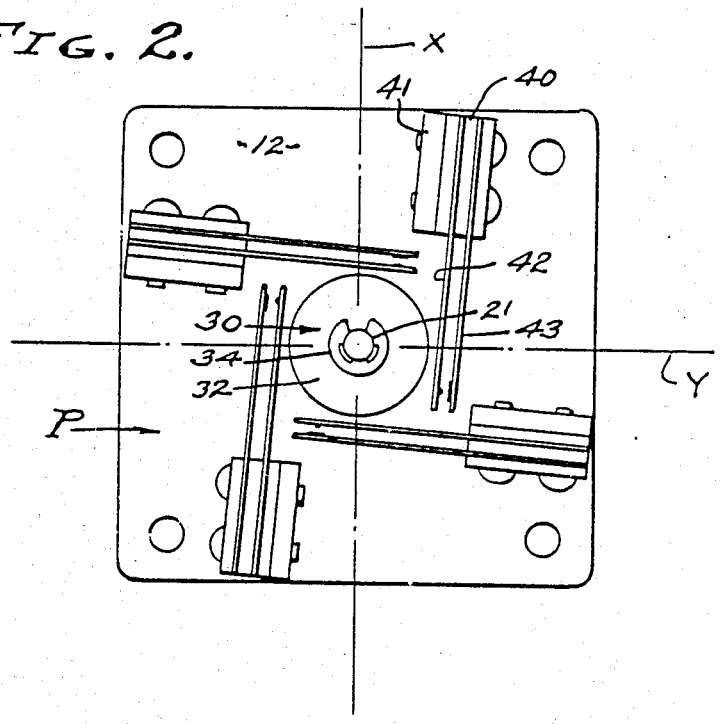

The joystick S of the present invention is capable of motion in two or more directions, and operates by a fore-and-aft motion along an axis X and by a side-to-side motion along an axis Y. 90° X and Y motions of joystick S are effective for video game switching in a four-way mode, while intermediate angular motions between said axes are additionally effective in an eight-way mode. In either case the joystick S can be moved through all the aforesaid positions, however the effect thereof is controlled by the gates hereinafter described. That is, the switch contact engagement by the joystick S is selectively controlled for at least two distinct modes of operation. The joystick is universally gimbaled and as it is disclosed herein involves a mounting plate P in which there is a socket 10 that receives a flange 11 for restricted movement of the joystick carried thereby, there being a centering spring means 29 seated in a switching cam 30, and there being a retainer 34 securing the assembly together as a unit.

The mounting plate P is a flat frame-like base of square configuration adapted to be mounted to the underside of the control deck in a video game machine (not shown). Accordingly, there are corner openings for mounting screws, there being a housing 12 as shown in FIGS. 11 through 19, underlying the mounting plate P as a part thereof or as a separate member, to enclose the switches and/or to mount the same, and also to carry a selectively positionable motion controlling gate G2′ or G2″ as later described. The center portion of the plate P is open for the movement therethrough of the joystick S with clearance, there being a stepped bore with an upwardly faced shoulder 13 for support of the joystick S. The lower portion 14 of said bore is stepped inwardly and is of right cylinder form to freely pass the stem of the manipulatable joystick, regardless of its position. The upper portion of said bore is stepped outwardly and its inner portion 15 at the shoulder 13 is of right cylinder form while its outer portion 16 is conical, upwardly divergent, for limiting movement as later described. The outer opening side of the stepped bore is closed by an eight-way control gate G1 as will be described, leaving the interior of said bore of sufficient height to permit tilting of the position limiting flange 11.

The joystick S is a straight elongated member separated into upper and lower legs 20 and 21 by the flange 11, all of which can be integral. Preferably, the flange 11 is a separate part in which case the legs 20 and 21 are separated by a step 22 faced downwardly to position the flange 11. Accordingly, the lower leg 21 is of the smaller diameter to freely pass through the lower portion 14 of the stepped bore in the base 12. As shown, the leg 20 is a straight cylindrical rod that extends well above the top of the base 12 or plate P where it carries a ball 23 by which it is grasped for manipulation. The leg 21 extends below the bottom of the plate P where it carries the switching cam 30. Essentially, the leg 20 is a manually operable lever and the leg 21 is a switch actuating lever carrying the cam 30 that is restrictively engageable with a four-way control gate G2 as will be described.

Figure 3:
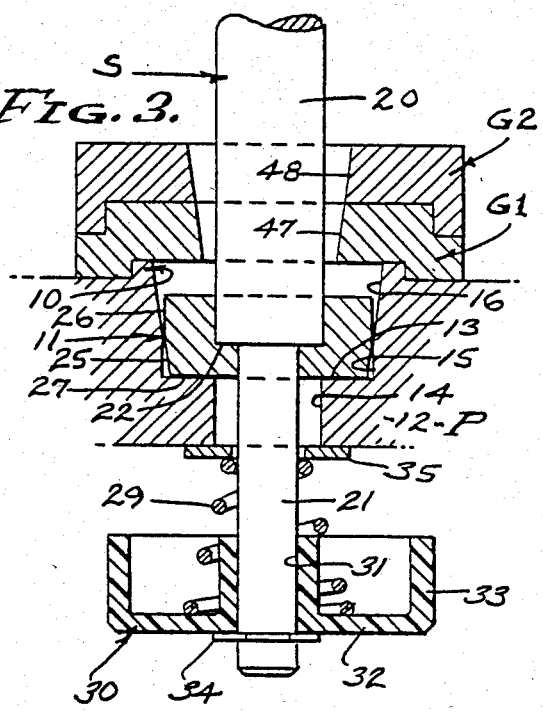
Figure 4:
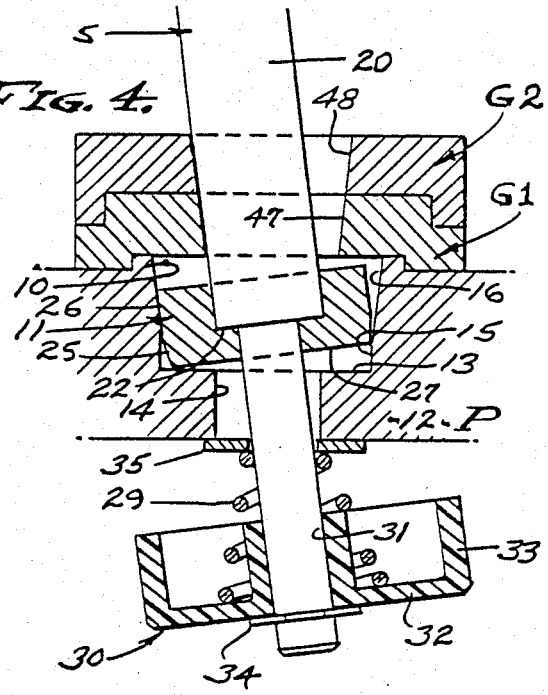

The flange 11 restricts and/or limits displaced movement of the joystick S and is characterized by an enlargement of or a part applied to the joystick at the joinder of the legs 20 and 21 thereof. The flange 11 is shown as a separate part slideably engaged over the lower leg 21 and seated on the step 22 to substantially occupy the outwardly stepped portion of the bore in the plate P. In accordance with this invention, the flange 11 has restricted movement within the confines of inner portion 15 and outer portion 16 of said stepped bore. Accordingly, the inner portion 25 of the flange 11 is conically tapered, downwardly and inwardly, from the outer right cylinder portion 26 thereof, while the bottom face 27 thereof is flat and in a plane normal to the axis of the joystick S. As shown in FIG. 4, the movement limit of angular displacement is restricted when the periphery of the outer cylinder portion 26 of flange 11 engages the conical outer portion 16 of the stepped bore (13-16) in the plate P. The conical inner portion 25 of the flange permits tnis tilted displacement of the flange, stopped as shown. It will be observed that the joinder of the cone and cylinder portions of the socket 10 and flange 11 lie in a common plane when the joystick S is centered as shown in FIG. 3.

The switching portion of the stick S is a circular cam member 30 carried by the lower leg 21, in spaced relation to the bottom of the plate P. The cam 30 has a bore 31 slideably engaged over the leg 21, and has a disc 32 disposed normal to the axis of the joystick. The snap ring retainer 34 engages the bottom side of disc 32 to secure the assembly, with the concentric rim 33 of the cam disposed within the switch contacts next described. Tightness of the assembly and yielding bias of the joystick to a centered position is by the compression spring means 29 seated between the plate P and the cam 30. As shown, the spring is conical as it tapers inwardly to the leg 21 where it seats against a washer 35 that slides against the plate as shown.

A common arrangement of switches in a video game controller of the type under consideration is the diametrical placement of a pair of switches on each axis X and Y. Accordingly, fore-and-aft motion will alternately actuate one of a pair of switches, and side-to-side motion will alternately actuate one of the other pair of switches. In practice, leaf type switches are employed as shown, carried by insulating blocks 40 fastened to depending struts 41 so that an inner member or leaf 42 thereof is normally spaced from the periphery of switching cam 30 to be tangentially engaged thereby when the cam is displaced to close said space and depress said leaf. Alternately, the switches are carried by the depending walls of the aforementioned housing 12 (not shown). The inner leaves of diametrically opposite switches are parallel and spaced equally from the central axis of the unit, and the four switches are right angularly related forming a square surrounding cam 30, and so that diagonal displacement of cam 30 will actuate adjacent switches in an eight-way mode. The square configuration of the inner switch leaves 42 inherently establishes an eight-way gating effect that permits diagonal as well as X and Y axis operation of the stick S. It is an object of this invention to limit this diagonal cam movement and thereby condition the device for a four-way mode whereby a single switch is actuated at a time. It is to be understood that other equivalent switch means can be employed, for example magnetically operated reed switches, and light sensitive cells, etc.

Switch construction can vary, and in the drawings are shown as conventional leaf switches, each with an outer leaf 43 spaced parallel to the inner leaf 42, and with contacts engageable when forced together by displacement of the cam engaging the inner leaf. It is the restrictive actuation of at least one of four switches in a four-way mode as distinguished from the additional actuation of at least two adjacent corner related switches in an eight-way mode with which this invention is particularly concerned, and to this end I have provided controlling gates G1 and G2.

The eight-way mode involves the actuation of either switch on each axis X and Y, and it also involves the simultaneous actuation of any one of four pairs of adjacent switches at each corner of gate G1 opening, providing eight switching positions. The gate G1 limits the depression of switch leaves 42 and establishes a square opening in or overlying the mounting plate P and through which the leg 20 passes with limited motion; and unobviously this is a square opening which establishes said eight-way mode of operation. The gate G2 provides an octagonal effect that unobviously creates a four-way mode of operation when selectively positioned therefor. The joystick S presents a first class lever wherein the fulcrum is between the resistance and the power, one leg 20 of which projects upwardly for manual engagement, and one leg 21 which projects downwardly to operate the controlling switches. In practice, the gate G1 is fixed over the leg 20 while gate G2 is selectively adjusted into either one of two positions relative to either the leg 20 or leg 21. The fulcrum of the joystick legs 20 and 21 occurs centrally on the plane of joinder between the conical portion 25 and cylinder portion 26 of flange 11, and this fulcrum lifts slightly as the flange 11 is tilted.

In accordance with this invention and in order to establish the eight-way mode of operation, the gate G1 has a fixedly positioned opening of square configuration with the walls thereof flared upwardly at a divergent angle and each stopping the leg 20 at the same angular displacement along axes X and Y. The leg 20 is stopped along axes X and Y when its outer cylinder wall establishes line contact with the flat divergent inner walls 47 of gate G1. The flat sided opening configuration of gate G1 is such as to allow depression of a leaf 42 of one switch when moved in alignment with either axis X or Y (four positions), and also to allow simultaneous depression of adjacent right angularly related leaves 42 of two switches when moved diagonally into any one of the corners of said square opening configuration (four additional positions), thereby establishing the eight-way mode of operation. Accordingly, the gate G1 permits four axis aligned switching positions and four corner switching positions, for a total of eight switching positions, the latter four corner switching positions to be occluded by selective positioning of the gate G2 next to be described.

In accordance with this invention, and in order to modify the eight-way gating and establish the four-way mode of operation, the gate G2 is provided to occlude the aforesaid four corner positions, whereby pairs of adjacent switches are precluded from being actuated while permitting singular actuation of switches along axes X and Y. The gate G2 is selectively positionable to permit the aforesaid eight switching positions of the gate G2, and alternately positionable to occlude the corner switching positions of the gate G1. The gate G2 is characterized by members that are alternately entered into and retracted from positions that establish the occlusion of the aforesaid corner positions. In practice, the gates G1 and G2 can engage and restrict movement of either leg 20 or 21 of the joystick S, since these two legs operate together as an integral lever so that the position of one reflects the position of the other. The alternately positionable members that occlude the corner positions established by the gate G1 are abuttments (48, 48' and 48'') disposed-spaced 90° apart and equidistant from the normal central axis of the unit.

Figure 5:
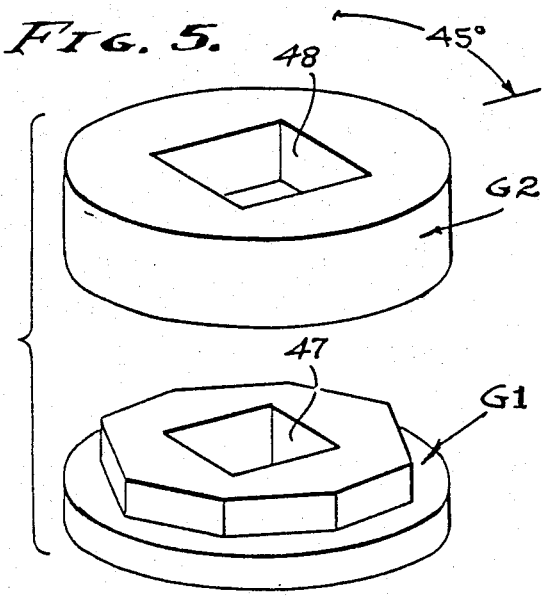
Figure 7:
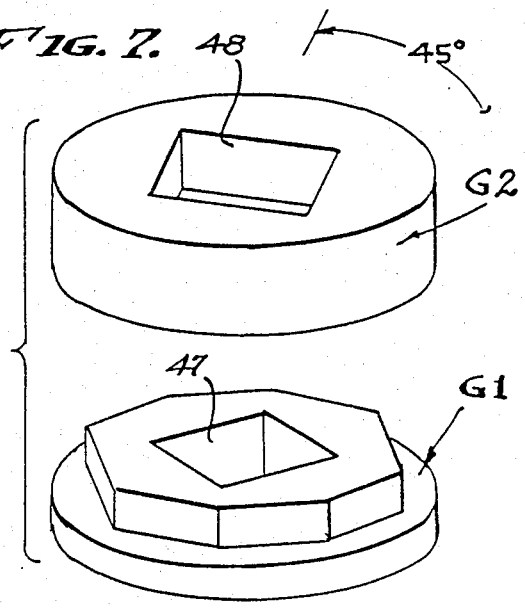
Figure 6:
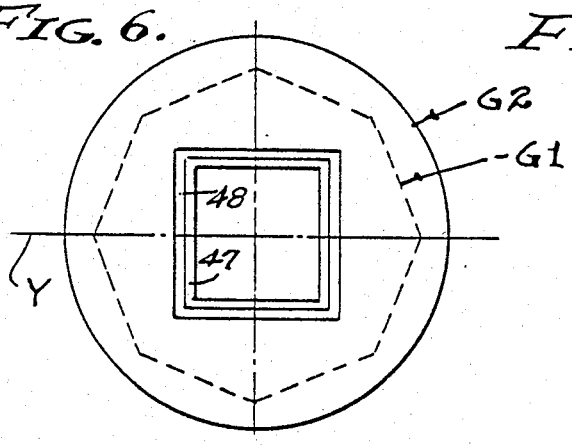
Figure 8:
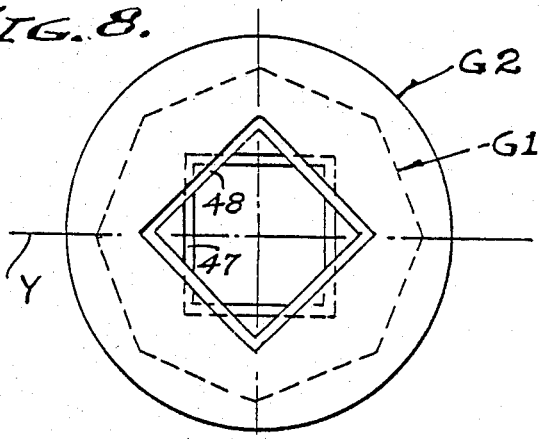

Referring now to a first embodiment and combination of gates G1 and G2 as shown in FIGS. 1 through 10 of the drawings, the two cooperative gates G1 and G2 are carried by the plate P to engage and limit movement of the upper leg 20 of joystick S. The gate G1 that permits eight-way positioning of the joystick S presents an immoveable square opening as shown in FIGS. 5 and 7, and having the divergent inner walls 47 for limiting movement of the leg 20, as best shown in FIG. 3. In this first embodiment the gate G2 is superimposed over gate G1 and is selectively moveable by rotation into alternate positions, one permitting the eight-way positioning of the joystick and the other limiting four-way positioning of the joystick. In order to establish the four-way mode of operation, the gate G2 has an opening of square configuration with abuttment walls 48 flared upwardly and continuing from the walls 47 of gate G1, when rotatively aligned, and thereby stopping the leg 20 at the same angular displacements as the gate G1. The leg 20 is stopped along axes X and Y when its outer cylinder wall establishes line contact with the flat divergent inner walls 47 and 48 of gates G1 and G2. The flat sided opening configurations of gates G1 and G2 is sufficient to allow depression of a leaf 42 of one switch when moved in alignment with either axis X or Y, and also to allow depression of adjacent right angularly related leaves 42 of two switches when moved diagonally into a corner of said square opening configuration, thereby establishing an eight-way mode of operation.

The gate G2 is concentrically superimposed over the gate G1 with its inner walls 48 continuing in planar fashion from the walls 47 of gate G1, when in the eight-way mode. In accordance with this invention, the gate G2 is adapted to be rotatably adjusted to an angular displacement of 45°, whereby the corner portions of the square openings through gates G1 and G2 are occluded by the flat side walls thereof respectively. Accordingly, the composite effect is the establishment of an octagonal opening configuration (see FIG. 8). The opening of gate G1 remains fixedly oriented, however the inner abuttment walls 48 occlude each of the four corners of the opening through gate G1, thereby precluding diagonal actuation of two adjacent switches and thereby establishing a four-way mode of operation.

The change-over from mode to mode is by adjustment means rotatably positioning the gate G2 with respect to the fixedly positioned gate G1. As shown in this first embodiment the adjustment means is a plug and socket means involving keyed engagement of the two gates. The exterior of gate G1 is octagonal at 50 and the socket interior of gate G2 is of complementary form and/or octagonal to have two effective positions, straight through and occluded. Alternately, the plug and socket can be cylindrical with key and slot engagement for said two mode positions.

Referring now to a second embodiment of gate G2′ as shown in FIGS. 11 through 14 of the drawings, the selectively controllable gate G2′ is carried by the housing 12 and limits movement of the lower leg 21 of joystick S. The gate G1 remains as above described in the first embodiment to permit eight-way switching, while the gate G2′ is comprised of axially shiftable abuttment pins 48′ moveable into alternate positions, one permitting the eight-way positioning of the joystick and the other limiting four-way positioning of the joystick. In order to establish the four-way mode of operation, the gate G2′ is comprised of a set of four abuttment pins 48′, each adapted to enter and retract from a position occluding a corner position of the joystick and/or of the cam 30 carried thereby. In practice, it is preferred that the abuttment pins 48′ engage and disengage the cam 30 as shown by the alternate positioning thereof in FIGS. 11 and 13.

Figure 9:
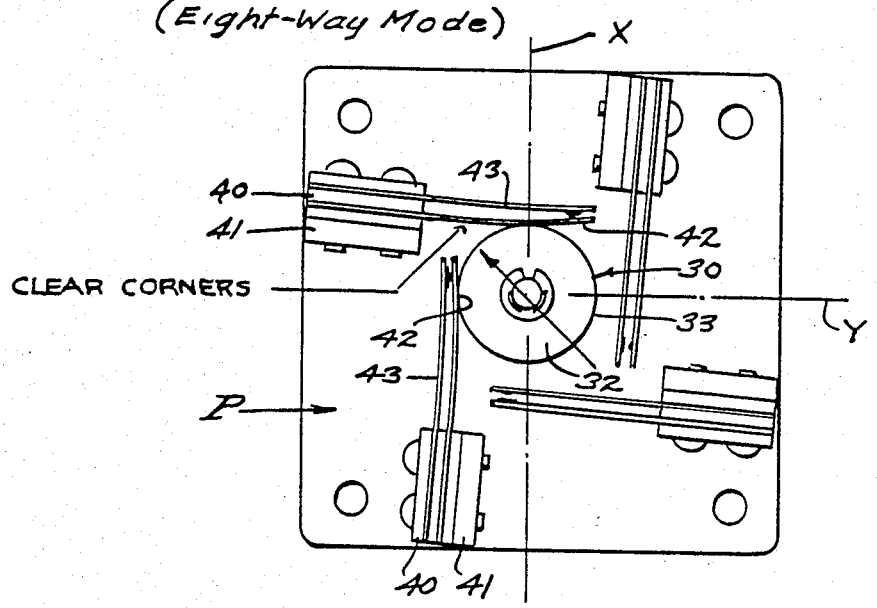
Figure 10:
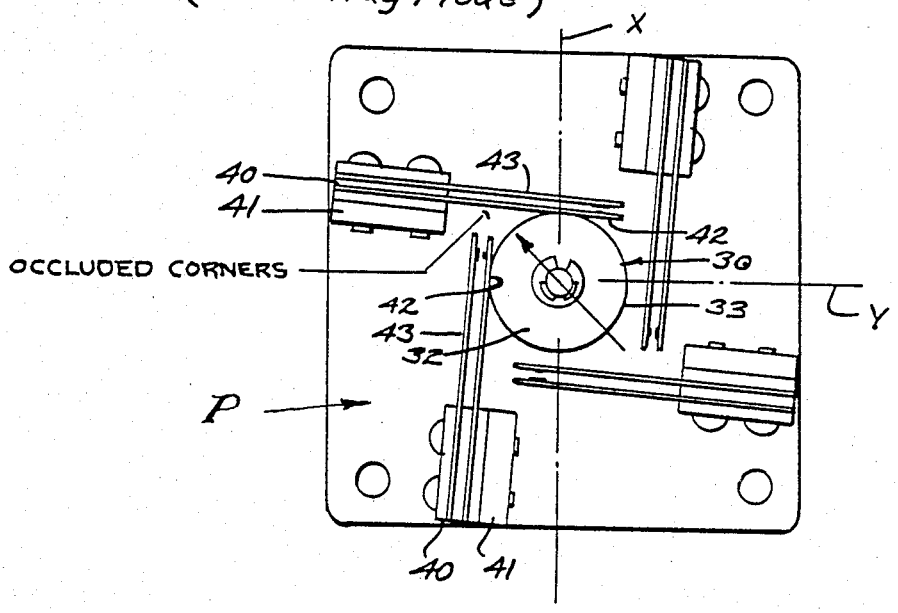
Figure 11:
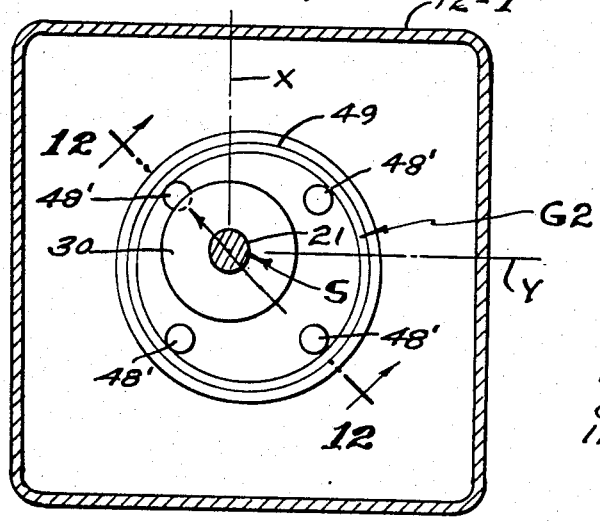
FIGS. 11 through 14 show a second embodiment.
Figure 12:
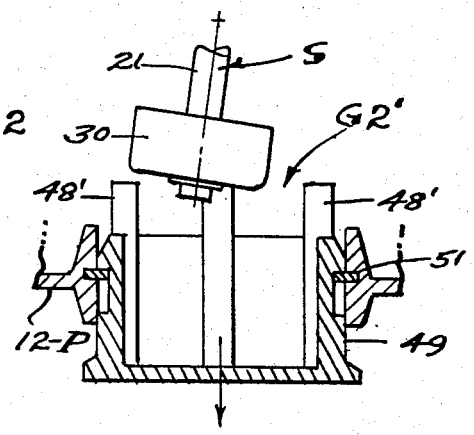
Figure 13:
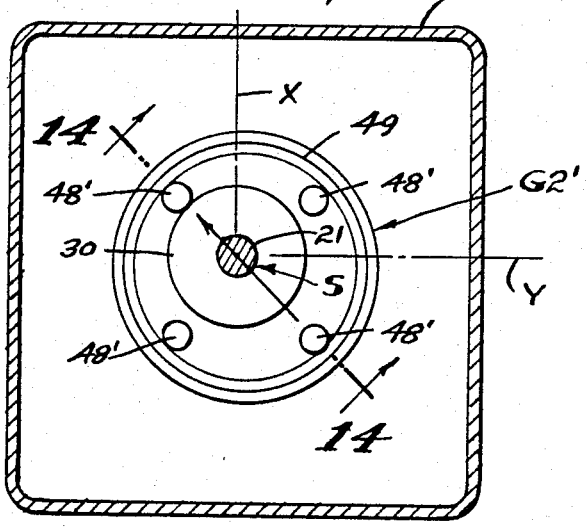
Figure 14:
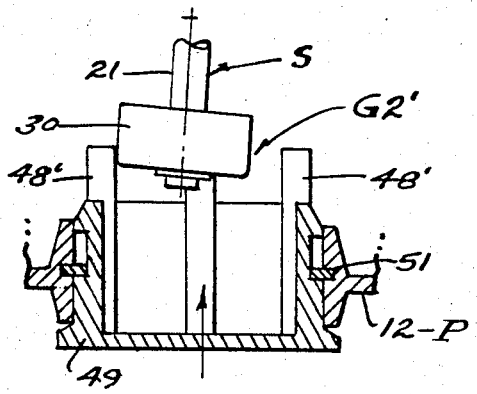
Figure 15:
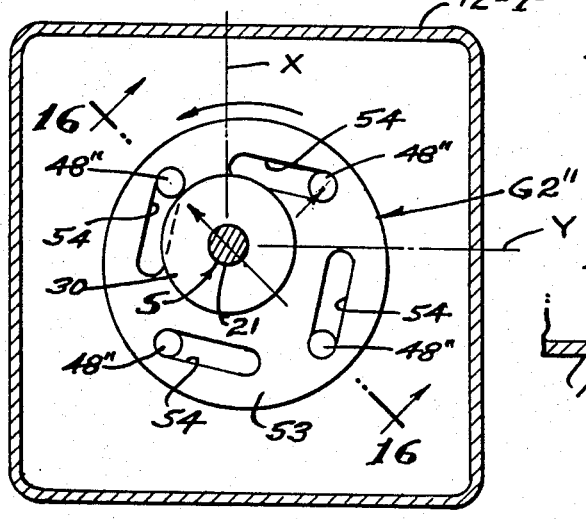
FIGS. 15 through 19 show a third embodiment.

In order to establish the eight-way mode of operation, the gate G2′ is retracted reciprocally as shown in FIG. 12, whereby the cam 30 on joystick S is permitted to enter the corner positions, as illustrated in FIG. 9. In order to establish the four-way mode of operation, the gate G2′ is protected reciprocally as shown in FIG. 14, whereby the cam 30 on joystick S is precluded from entering the corner positions, as illustrated in FIG. 10. In FIGS. 9 and 10 the cam 30 has eight-way and four-way modes of operation respectively.

The gate G2′ comprised of abuttment pins 48′ is a selectively positionable occlusion means by which the four corner positions of the joystick S can be excluded from the switching operations. As shown in this second embodiment, the pins 48′ are equally spaced in a circular pattern about the normal center axis of the unit, and on parallel axes spaced radially from said center axis. The pins 48′ are slideable through the housing 12 and can be moved individually into and out of the occluding positions, and preferably they are moved together by means of a shiftable plug 49. The plug 49 is a manually positionable member, and the positions thereof and of the pins 48′ carried thereby held by a constricting friction means 51. As shown, the manually positionable plug 49 is accessible beneath the housing 12.

Referring now to a third embodiment of gate G2″ as shown in FIGS. 15 through 18 of the drawings, the selectively controllable gate G2″ is carried by the housing 12 and limits movement of the lower leg 21 of joystick S. The gate G1 remains as above described in the first embodiment to permit eight-way switching, while the gate G2″ is comprised of radially shiftable abuttments 48″ moveable into alternate positions, one permitting the eight-way positioning of the joystick and the other limiting four-way positioning of the joystick. In order to establish the four-way mode of operation, the gate G2″ is comprised of a set of four abuttment members 48″, each adapted to enter and retract from a position occluding a corner position of the joystick and/or of the cam 30 carried thereby. In practice, it is preferred that the abuttment members 48″ engage and disengage the cam 30 as shown by the alternate positioning thereof in FIGS. 15 and 17.

Figure 16:
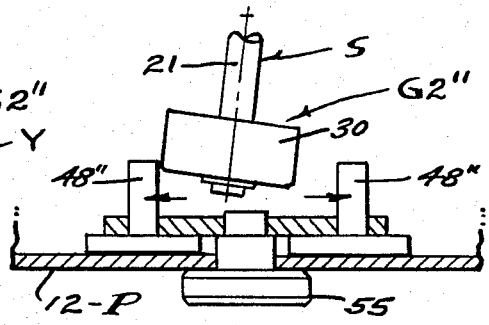
Figure 18:
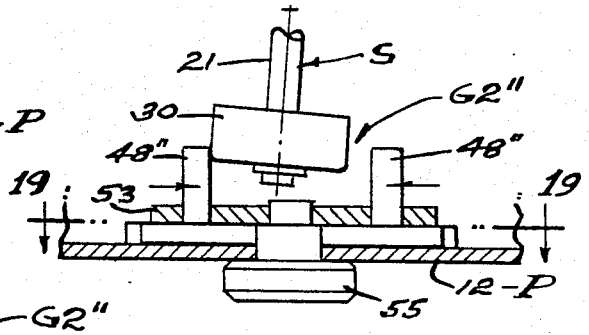
Figure 17:
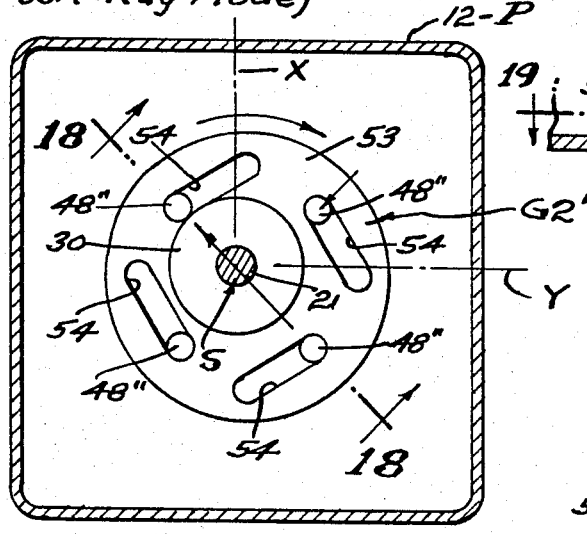
Figure 19:
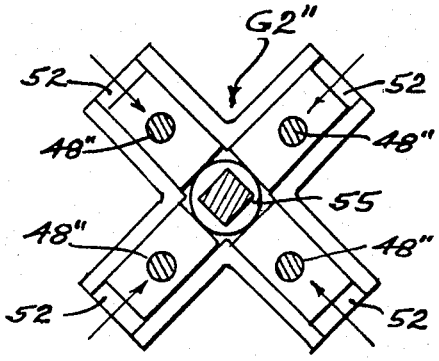

In order to establish the eight-way mode of operation, the gate G2″ is retracted radially as shown in FIG. 16, whereby the cam 30 on joystick S is permitted to enter the corner positions, as illustrated in FIG. 9. In order to establish the four-way mode of operation, the gate G2″ is contracted radially as shown in FIG. 18, whereby the cam 30 on joystick S is precluded from entering the corner positions, as illustrated in FIG. 10. In FIGS. 9 and 10 the cam 30 has eight-way and four-way modes of operation respectively.

The gate G2″ comprised of abuttment 48″ is a selectively positionable occlusion means by which the four corner positions of the joystick S can be excluded from the switching operations thereof. As shown in this third embodiment, the abuttment members 48″ are equally spaced in a circular pattern about the normal center axis of the unit, and are carried in radially disposed guideways 52 (see FIG. 19) to shift alternately between radially retracted and contracted positions relative to said center axis. The abuttments 48″ can be moved individually into and out of the occluding positions, and preferably they are moved together by means of a cam plate 53 having involute or like openings 54 engaged slideably with each abuttment members 48″, to move them inwardly and outwardly, radially, when plate 53 is revolved a part turn (see FIGS. 15 and 17). As shown, the cam plate 53 overlies the guideways 52, and all of which is carried by the housing 12 beneath the switching means hereinabove described. The cam plate 52 is positioned by a control knob 55 accessible beneath the housing 12.

From the foregoing it will be understood how the joystick of the present invention is carried by a mounting plate and effectively gimbaled on X and Y axes. The diametric placement of switches along axes X and Y is conducive to four-way and eight-way modes of operation as hereinabove described, and these two modes are selected by positioning the gate G2 (G2′–G2″) which occludes the operational corner positions of the gate G1, thereby limiting operation to a four-way mode as distinguished from an eight-way mode.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A joystick control for the selective actuation of at least two contact members along right angularly related X and Y axes intersecting a centered axis of a gimbaled joystick, and including;

a mounting fixedly carrying said at least two contact members disposed about said X and Y axes in right angular relation to each other forming an opening configuration for simultaneous actuation of said at least two right angularly related contact members, the joystick being gimbaled on the mounting and extending therefrom to be tilted laterally from the centered axis and having a cam portion simultaneously engageable with said at least two right angularly related contact members, means yieldingly urging the joystick into alignment with the centered axis, and a selectively positionable gate carried by the mounting concentric with the centered axis and having an obstruction engageable with the joystick and restricting movement of the cam portion thereof into a corner area of the opening configuration between said angularly related contact members for individual actuation of each of said contact members.

2. The joystick control as set forth in claim 1, wherein a fixedly positioned gate obstruction is formed by a square opening therethrough surrounding and engaging the joystick restricting lateral tilting of the joystick coincidental with said at least two right angularly related contact members and permitting eight-way switching.

3. The joystick control as set forth in claim 1, wherein a fixedly positioned gate obstruction is formed by a square opening therethrough surrounding and engaging an upwardly extending leg of the joystick restricting lateral tilting thereof coincidental with said at least two right angularly related contact members and permitting eight-way switching.

4. The joystick control as set forth in claim 1, wherein the selectively positionable gate has a square opening therethrough surrounding and engaging the joystick, and in one position permitting lateral tilting of the joystick into a corner formed by said at least two right angularly related contact members for eight-way switching, and in an alternate position occluding the corner formed by said at least two right angularly related contact members restricting lateral tilting of the joystick thereby preventing simultaneous adjacent contact actuation for four-way switching.

5. The joystick control as set forth in claim 2, wherein the selectively positionable gate has a square opening therethrough surrounding and engaging the joystick, with one position permitting lateral tilting of the joystick into a corner formed by said at least two right angularly related contact members and the fixedly positioned gate for eight-way switching, and with an alternate position occluding the corner formed by said at least two right angularly related contact members and the fixedly positioned gate restricting lateral tilting of the joystick thereby preventing simultaneous adjacent switch actuation for four-way switching.

6. The joystick control as set forth in claim 3, wherein the selectively positionable gate has a square opening therethrough surrounding an upwardly extending leg of and engaging the joystick, with one position permitting lateral tilting of the joystick into a corner formed by said at least two right angularly related contact members and the fixedly positioned gate for eight-way switching, and with an alternate position occluding the corner formed by said at least two right angularly related contact members and the fixedly positioned gate and restricting lateral tilting of the joystick thereby preventing simultaneous switch actuation for four-way switching.

7. The joystick control as set forth in claim 1, wherein the selectively positionable gate is located on the mounting by means rotatably placing it in restrictive and non-restrictive positions with respect to the joystick.

8. The joystick control as set forth in claim 1, wherein the selectively positionable gate is located on the mounting by means rotatably placing it coincidental with a square opening formed by the contact members and alternately placing it at a 45° angular displacement thereto whereby corners of said square opening formed by the contact members are occluded thereby preventing simultaneous switch actuation.

9. The joystick control as set forth in claim 2, wherein the selectively positionable gate is located on the mounting by means rotatably placing it coincidental with a square opening formed by the contact members and fixedly positioned gate and alternately placing it at a 45° angular displacement thereto whereby corners of said square opening formed by the contact members and fixedly positioned gate are occluded thereby preventing simultaneous switch actuation.

10. The joystick control as set forth in claim 1, wherein the selectively positionable gate is located on the mounting by socket means rotatably placing it coincidental with a square opening formed by the contact members and alternately placing it at a 45° angular displacement thereto whereby corners of said square opening formed by the contact members are occluded thereby preventing simultaneous switch actuation.

11. The joystick control as set forth in claim 2, wherein the selectively positionable gate is located on the mounting by octagonal socket means rotatably placing it coincidental with a square opening formed by the contact members and fixedly positioned gate and alternately placing it at a 45° angular displacement thereto whereby corners of said square opening formed by the contact members and fixedly positioned gate are occluded thereby preventing simultaneous switch actuation.

12. A joystick control for the selective actuation of at least two contact members along right angularly related X and Y axes intersecting a centered axis of a gimbaled joystick, and including:

a mounting fixedly carrying said at least two contact members disposed about said X and Y axes in right angular relation to each other forming an opening configuration for simultaneous actuation of said at least two right angularly related contact members, the joystick being gimbaled on the mounting and having an upper leg extending therefrom to be tilted laterally from the centered axis and having a lower leg with a cam portion simultaneously engageable with said at least two right angularly related contact members, means yieldingly urging the joystick into alignment with the centered axis, and a selectively positionable gate carried by the mounting concentric with the centered axis and having an opening comprised of shiftable abuttments moveable into and out of position engageable with the joystick cam portion and restricting movement of the cam portion thereof into a corner area of the opening configuration between said angularly related contact members for individual actuation of each of said contact members.

13. The joystick control as set forth in claim 12, wherein the shiftable abuttments of the selectively positionable gate are axially shiftable.

14. The joystick control as set forth in claim 12, wherein the shiftable abuttments of the selectively positionable gate are radially shiftable.

15. The joystick control as set forth in claim 12, wherein a fixedly positioned gate is carried by the mounting concentric with the centered axis and having a square opening therethrough surrounding and engaging the joystick restricting lateral tilting thereof coincidental with a square opening formed by the contact members and permitting eight-way switching.

16. The joystick control as set forth in claim 12, wherein a fixedly positioned gate surrounds and engages the upwardly extending leg of the joystick concentric with the centered axis and having a square opening therethrough surrounding and engaging the joystick restricting lateral tilting thereof coincidental with a square opening formed by the contact members and permitting eight-way switching.

17. The joystick control as set forth in claim 15, wherein the abuttments of the selectively positionable gate are retracted in one position permitting lateral tilting of the joystick coincidental with a square opening formed by the contact members for eight-way switching and are protracted in an alternate position occluding the corners of the square opening of the contact members restricting lateral tilting of the joystick thereby preventing simultaneous adjacent switch actuation.

18. The joystick control as set forth in claim 16, wherein the abuttments of the selectively positionable gate are retracted in one position permitting lateral tilting of the joystick coincidental with a square opening formed by the contact members and fixedly positioned gate for eight-way switching and are protracted in an alternate position occluding the corners of the square opening of the contact members and fixedly positioned gate and restricting lateral tilting of the joystick thereby preventing simultaneous adjacent switch actuation.

19. The joystick control as set forth in claim 15, wherein the shiftable abuttments of the selectively positionable gate are axially shiftable pins with means retractably protracting them into engageable position with the joystick cam portion for restrictive lateral tilting thereof.

20. The joystick control as set forth in claim 16, wherein the shiftable abuttments of the selectively positionable gate are axially shiftable pins with means retractably protracting them into engageable position with the joystick cam portion for restrictive lateral tilting thereof.

21. The joystick control as set forth in claim 17, wherein the shiftable abuttments of the selectively positionable gate are axially shiftable pins with means retractably protracting them into engageable position with the joystick cam portion for restrictive lateral tilting thereof.

22. The joystick control as set forth in claim 18, wherein the shiftable abuttments of the selectively positionable gate are axially shiftable pins with means retractably protracting them into engageable position with the joystick cam portion for restrictive lateral tilting thereof.

23. The joystick control as set forth in claim 15, wherein the shiftable abuttments of the selectively positionable gate are axially shiftable pins carried by a manually positionable plug and retractably protractable thereby into engageable position with the joystick cam portion for restrictive lateral tilting thereof.

24. The joystick control as set forth in claim 16, wherein the shiftable abuttments of the selectively positionable gate are axially shiftable pins carried by a manually positionable plug and retractably protractable thereby into engageable position with the joystick cam portion for restrictive lateral tilting thereof.

25. The joystick control as set forth in claim 17, wherein the shiftable abuttments of the selectively positionable gate are axially shiftable pins carried by a manually positionable plug and retractably protractable thereby into engageable position with the joystick cam portion for restrictive lateral tilting thereof.

26. The joystick control as set forth in claim 18, wherein the shiftable abuttments of the selectively positionable gate are axially shiftable pins carried by a manually positionable plug and retractably protractable thereby into engageable position with the joystick cam portion for restrictive lateral tilting thereof.

27. The joystick control as set forth in claim 15, wherein the shiftable abuttments of the selectively positionable gate are radially shiftable members with means retractably contracting them into engageable position with the joystick cam portion for restrictive lateral tilting thereof.

28. The joystick control as set forth in claim 16, wherein the shiftable abuttments of the selectively positionable gate are radially shiftable members with means retractably contracting them into engageable position with the joystick cam portion for restrictive lateral tilting thereof.

29. The joystick control as set forth in claim 17, wherein the shiftable abuttments of the selectively positionable gate are radially shiftable members with means retractably contracting them into engageable position with the joystick cam portion for restrictive lateral tilting thereof.

30. The joystick control as set forth in claim 18, wherein the shiftable abuttments of the selectively positionable gate are radially shiftable members with means retractably contracting them into engageable position with the joystick cam portion for restrictive lateral tilting thereof.

31. The joystick control as set forth in claim 15, wherein the shiftable abuttments of the selectively positionable gate are radially shiftable members carried in radially disposed guideways and shifted therealong by a manually positionable cam plate retractably contracting them into engageable position with the joystick cam portion for restrictive lateral tilting thereof.

32. The joystick control as set forth in claim 16, wherein the shiftable abuttments of the selectively positionable gate are radially shiftable members carried in radially disposed guideways and shifted therealong by a manually positionable cam plate retractably contracting them into engageable position with the joystick cam portion for restrictive lateral tilting thereof.

33. The joystick control as set forth in claim 17, wherein the shiftable abuttments of the selectively positionable gate are radially shiftable members carried in radially disposed guideways and shifted therealong by a manually positionable cam plate retractably contracting them into engageable position with the joystick cam portion for restrictive lateral tilting thereof.

34. The joystick control as set forth in claim 18, wherein the shiftable abuttments of the selectively positionable gate are radially shiftable members carried in radially disposed guideways and shifted therealong by a manually positionable cam plate retractably contracting them into engageable position with the joystick cam portion for restrictive lateral tilting thereof.

* * * * *